US007204711B2

(12) United States Patent
Garcia et al.

(10) Patent No.: US 7,204,711 B2
(45) **Date of Patent: *Apr. 17, 2007**

(54) LAMP SOCKET

(76) Inventors: Ismael Garcia, 5012 S. Laporte, Chicago, IL (US) 60638; John Pakledinaz, 125 N. Sylvan, Mundelein, IL (US) 60060

( * ) Notice: Subject to any disclaimer, the term of this patent is extended or adjusted under 35 U.S.C. 154(b) by 0 days.

This patent is subject to a terminal disclaimer.

(21) Appl. No.: 11/148,848

(22) Filed: Jun. 9, 2005

(65) Prior Publication Data

US 2005/0227541 A1 Oct. 13, 2005

Related U.S. Application Data

(63) Continuation of application No. 10/463,244, filed on Jun. 17, 2003, now Pat. No. 7,052,301.

(51) Int. Cl.
*H01R 13/625* (2006.01)

(52) U.S. Cl. ..... 439/336; 439/699.2; 439/881; 362/252; 362/548

(58) Field of Classification Search ..... 439/336, 439/749, 854–855, 881, 699.2; 362/252, 362/421, 548
See application file for complete search history.

(56) References Cited

U.S. PATENT DOCUMENTS

| | | | | |
|---|---|---|---|---|
| 3,114,508 | A | 12/1963 | Trautner et al. | 362/549 |
| 3,344,388 | A | 9/1967 | Parker et al. | |
| 3,936,131 | A | 2/1976 | Durand | 439/558 |
| 3,947,083 | A | 3/1976 | Ahmed et al. | 439/857 |
| 3,950,061 | A | 4/1976 | Kausen | 439/385 |
| 3,977,757 | A | 8/1976 | Yurtin | |
| 4,181,390 | A | 1/1980 | Aizawa | 439/375 |
| 4,367,573 | A | 1/1983 | Baba et al. | 445/27 |
| 4,390,936 | A | 6/1983 | Slater, Jr. et al. | 362/548 |

(Continued)

FOREIGN PATENT DOCUMENTS

| | | |
|---|---|---|
| FR | 2739229 | 3/1997 |
| FR | 2740616 | 4/1997 |

OTHER PUBLICATIONS

AMP—Terminal Specification Sheets—Interconnection Systems; Selection Guide 82750; Revised Jul. 1995.

(Continued)

*Primary Examiner*—Michael C. Zarroli

(57) ABSTRACT

The present invention provides a lamp socket having a socket body with a lamp receiving portion and a back portion divided by a partition. The back side of the partition has a shelf and a recessed portion that extends inwardly relative to the shelf. The lamp socket also has at least one terminal in the socket body, the terminal has a lamp receiving end and a lead receiving end, and the lead receiving end is located in the back portion of the body. The lead receiving end extends from the shelf over the recessed portion. At least one wire lead is connected to the lead end of the terminal and the lead end is spaced outwardly from the partition. Potting material in the back portion of the socket to encapsulate the connection of the wire lead to the terminal. The potting material fills the recessed portion and the terminal fully encapsulating the connection point of the lead to the terminal.

10 Claims, 8 Drawing Sheets

U.S. PATENT DOCUMENTS

| | | | | |
|---|---|---|---|---|
| 4,482,944 | A | 11/1984 | Roossine et al. | |
| 4,588,248 | A | 5/1986 | Moore | 439/272 |
| 4,647,132 | A | 3/1987 | Mikola | 439/345 |
| 4,883,434 | A | 11/1989 | Toyoshima | 439/619 |
| 4,907,343 | A | 3/1990 | Dolan et al. | 29/707 |
| 4,957,455 | A | 9/1990 | Horiuchi et al. | 439/548 |
| 5,008,588 | A | 4/1991 | Nakahara | 313/318.1 |
| 5,032,090 | A | 7/1991 | Roy | 439/619 |
| 5,046,970 | A | 9/1991 | Brodner et al. | 439/699.2 |
| 5,078,625 | A | 1/1992 | Anzai | |
| 5,096,427 | A | 3/1992 | Sadigh-Behzadi | 439/76.1 |
| 5,105,346 | A | 4/1992 | Acks et al. | |
| 5,112,255 | A | 5/1992 | Daley, Jr. | 439/885 |
| 5,156,560 | A | 10/1992 | Thomas | 439/699 |
| 5,228,766 | A | 7/1993 | Makita et al. | |
| 5,236,098 | A | 8/1993 | Sadigh-Behzadi | |
| 5,286,223 | A | 2/1994 | Ogawa | 439/619 |
| 5,466,174 | A | 11/1995 | Savage | |
| 5,536,175 | A | 7/1996 | Forish | |
| 5,547,402 | A | 8/1996 | Ogawa | 439/699.2 |
| 5,634,823 | A | 6/1997 | Furuta et al. | 439/699.2 |
| 5,709,571 | A | 1/1998 | Briski et al. | 439/699.2 |
| 5,716,240 | A | 2/1998 | Harada | 439/699.2 |
| 5,727,873 | A | 3/1998 | Tyson | 362/294 |
| 5,795,170 | A | 8/1998 | Okabe | 439/252 |
| 5,800,183 | A | 9/1998 | Paul et al. | 439/56 |
| 5,823,806 | A | 10/1998 | Nagase et al. | 439/140 |
| 5,846,100 | A | 12/1998 | Ogawa | 439/736 |
| 5,876,249 | A | 3/1999 | Kim | 439/557 |
| 5,895,295 | A * | 4/1999 | Harada | 439/699.2 |
| 5,951,318 | A | 9/1999 | Harada | 439/356 |
| 5,954,533 | A | 9/1999 | Hatagishi et al. | |
| 5,971,814 | A * | 10/1999 | Boyd et al. | 439/699.2 |
| 6,039,579 | A | 3/2000 | Paul et al. | 439/56 |
| 6,040,659 | A | 3/2000 | Masuda et al. | 315/56 |
| 6,049,163 | A | 4/2000 | Masuda et al. | 313/318.12 |
| 6,083,050 | A | 7/2000 | Hsu | 439/619 |
| 6,162,084 | A | 12/2000 | Chen et al. | 439/336 |
| 6,224,428 | B1 | 5/2001 | Chen et al. | 439/694 |
| 6,464,539 | B2 | 10/2002 | Yoshida et al. | 439/619 |
| 6,467,942 | B2 * | 10/2002 | Alloway et al. | 362/549 |
| 7,014,510 | B2 | 3/2006 | Powers et al. | |
| 2003/0068929 | A1 | 4/2003 | Powers et al. | |
| 2004/0132336 | A1 | 7/2004 | Powers et al. | |

OTHER PUBLICATIONS

Packard Socket—Photo—In public use before Jun. 17, 2002.

Zanaxx W-3 Socket—Ford Vehicle—2 Photos—In public use before Jun. 17, 2002.

U.S. Appl. No. 10/264,221, filed Oct. 3, 2003; Wedge Base Sealed Lamp Socket; Inventors: Powers et al.

Cemm Thome WBF PA66 lamp socket, on sale prior to Jun. 17, 2002, photographs 1-7 and sketch of terminal.

Prior Art. Fig. 9 Continuous Strip Terminals.

Tricon 1 and Tricon 2 lamp socket, five photographs.

Cemm Thome W-3 Socket—in Public use before Jun. 17, 2002 3 photos.

Cemm Thome PA66 Wedge Base Lamp Socket, on sale prior to Jun. 17, 2002. Photographs (Figs. 1-4) and terminal sketches (Figs. 5-6).

Cemm Thome Bayonet Lamp Socket, on sale prior to Jun. 17, 2002. Photographs (Figs. 7-8) and drawings (Figs. 9-13).

*Christiana Industries, Inc.* v. *Empire Electronics, Inc.*, Plaintiff's Complaint, In the United States District Court for the Eastern District of Michigan, filed Jun. 9, 2006, 23 pages.

*Christiana Industries, Inc.* v. *Empire Electronics, Inc.*, Plaintiff's Motion for Preliminary Injunction, In the United States District Court for the Eastern District of Michigan, filed Jun. 27, 2006, 3 pages.

*Christiana Industries, Inc.* v. *Empire Electronics, Inc.*, Brief in Support of Plaintiff's Motion for Preliminary Injunction, In the United States District Court for the Eastern District of Michigan, filed Jun. 27, 2006, 30 pages plus Exhibits A-G.

*Christiana Industries, Inc.* v. *Empire Electronics, Inc.*, Defendant's Brief in Opposition to Plaintiff's Motion for Preliminary Injunction, In the United States District Court for the Eastern District of Michigan, filed Jul. 13, 2006, 17 pages plus Exhibit E.

*Christiana Industries, Inc.* v. *Empire Electronics, Inc.*, Plaintiff's Reply to Defendant's Brief in Opposition to Plaintiff's Motion for a Preliminary Injunction, In the United States Court for the Eastern District of Michigan, filed Jul. 17, 2006, 10pages plus Exhibits.

*Christiana Industries, Inc.* v. *Empire Electronics, Inc.*, Transcript of Hearing Motion for Preliminary Injunction, In the United States District Court for the Eastern District of Michigan, Jul. 19, 2006, 87 pages.

*Christiana Industries, Inc.* v. *Empire Electronics, Inc.*, Opinion and Order Granting Plaintiff's Motion for a Preliminary Injunction, In the United States District Court for the Eastern District of Michigan, filed Jul. 25, 2006, 20 pages.

Request for *Inter Partes* Reexamination (2 page transmittal, 26 page brief and exhibits A-M); filed Sep. 13, 2006.

Notice of Failure to Comply with *Inter Partes* Reexamination Request Filing Requirements; 5 pages; mailed Oct. 3, 2006.

Response to Failure to Comply with *Inter Partes* Reexamination Request (2 pages) and Revised Request for *Inter Partes* Reexamination (26 pages); filed Oct. 6, 2006.

Notice of Assignment of *Inter Partes* Reexamination Request; 1 page; mailed Oct. 13, 2006.

Notice of *Inter Partes* Reexamination Request Filing Date; 1 page; mailed Oct. 13, 2006.

* cited by examiner

LAMP SOCKET

CROSS REFERENCE TO RELATED APPLICATIONS

This is a continuation of application Ser. No. 10/463,244, filed Jun. 17, 2003 now U.S. Pat. No. 7,052,301.

BACKGROUND OF THE INVENTION

This invention relates to lamp sockets, and in particular, wedge base sealed lamp sockets useful in automotive lighting. Such wedge base sealed lamp sockets are available commercially from Christiana Industries, LLC, Chicago, Ill.

Prior art lamp sockets for wedge base lamps mechanically secure the lamp in place within the socket and provide the lamp with electrical power. Conventional lamps have a wedge base holding a plurality of wire leads that are connected to one or more filaments within the lamp. Corresponding sockets comprise a socket body and a plurality of terminals located within the socket body for making electrical connection to respective lamp leads. One end of each terminal is located in a lamp base receiving channel of the socket body while the other end of each terminal is located in a back portion of the body. The back end of each terminal is connected to a wire lead which provides power to the terminal and lamp.

One function of the socket is to environmentally protect the connection of the wire leads to the terminals. Gaskets have been used to seal between the wire lead and the socket body. Another known method of environmentally sealing the connection is known as potting. The socket body is potted by injecting a resin into the back of the socket where the connection is made thereby preventing the elements from degrading or causing a failure of the connection. One problem that can occur in current sockets is when the potting resin imperfectly seals the connection, which can lead to socket failures.

Low profile sockets are desirable. A "low profile" socket has back portion that extends a minimal distance rearwardly from a fixture. Low profile sockets typically utilize a right angle terminal. In sockets with right angle terminals, the wire leads enter the socket radially, rather than axially. Right angle terminals comprise a crimp cradle and blade portions that are perpendicular to each other. Conventionally, the blades lie in the same vertical plane as the crimp cradle.

It is more difficult to manufacture sockets with right angle terminals, as compared to axial terminals. Terminals are fabricated in strips that are coiled into rolls. The strips are unwound and fed into automated machines that strip the wire leads, place the leads into the terminal crimp cradle and crimp the terminal to the lead. Because right angle terminals are bulky as compared to axial terminals, far fewer terminals can be stored on a terminal strip roll. Further, the blade portions of the terminals extend outwardly exposing them to potential damage in the assembly process, which can lead to defective sockets.

In addition to making a good electrical connection, the socket also mechanically secures the lamp. Spring clips and other stabilizing means have been incorporated into some socket bodies to grip the lamp base and minimize lamp wobbling. It has been difficult to position a spring clip within the socket body to effectively grip the lamp base without interfering with the electrical terminals.

Thus, there is a need for an improved lamp socket.

SUMMARY OF THE INVENTION

The foregoing concerns are addressed by the embodiments of the lamp socket of the present invention. One preferred embodiment of the present invention provides a lamp socket having a socket body with a lamp receiving portion and a back portion divided by a partition. The back side of the partition has a shelf and a recessed portion. The recessed portion extends inwardly relative to the shelf. The lamp socket has at least one terminal in the socket body. The terminal has a lamp receiving end and a lead receiving end, and the lead receiving end is located in the back portion of the body. The lead receiving end of the terminal extends from the shelf over the recessed portion. At least one wire lead is connected to the lead end of the terminal and the lead end is spaced outwardly from the partition. Potting material in the back portion of the socket body encapsulates the connection of the wire lead to the terminal. The potting material fills the recessed portion, fully encapsulating the connection point of the lead to the terminal.

In another embodiment, a one-piece right angle terminal has a lead receiving end adapted for connection to a wire lead. The lead receiving end has a crimp cradle which defines a cradle axis. The right angle terminal further has a lamp receiving end adapted for receiving a wedge base lamp, the lamp receiving end having at least one blade forming a blade axis. The cradle axis and the blade axis are substantially perpendicular to one another and lie in the same horizontal plane or in substantially parallel horizontal planes.

Another embodiment of the present invention provides a cap over the back portion of the socket body. The cap preferably includes legs extending inward in the socket body. Further the cap can be color coded for different customers or applications.

In another embodiment, the back portion of the socket body has side walls having grooves adapted to be gripped by a robot arm. A directional indicator is also provided on the back portion of the body.

Another embodiment for a lamp socket of the invention has an improved spring clip. The socket body has a lamp base receiving channel. Terminals are located in the channel in off-set position to make contact with off-set leads on the lamp base. The spring clip is located in the middle of the channel and has legs on each side of the channel, the legs being laterally offset to one another.

In a method of making a lamp socket, a socket body and a terminal strip are provided. The terminals have a cradle axis and a blade axis lying substantially in the same horizontal plane. A wire lead is crimped to a terminal, which is removed from the terminal strip and inserted into the socket body. The back of the socket body is potted with a resin to fully encapsulate the crimped connection of the lead to the terminal.

DETAILED DESCRIPTION OF PREFERRED EMBODIMENT

Turning now to the drawings, two preferred embodiments of the invention are shown and described below that are presently deemed by the inventors to be the best mode for carrying out the invention. However, it is to be understood that these embodiments are merely illustrative of the invention, are not to be construed as limiting the invention defined by the appended claims, and that the invention may take form in other embodiments that will be apparent to those skilled in the art.

Figure 1:
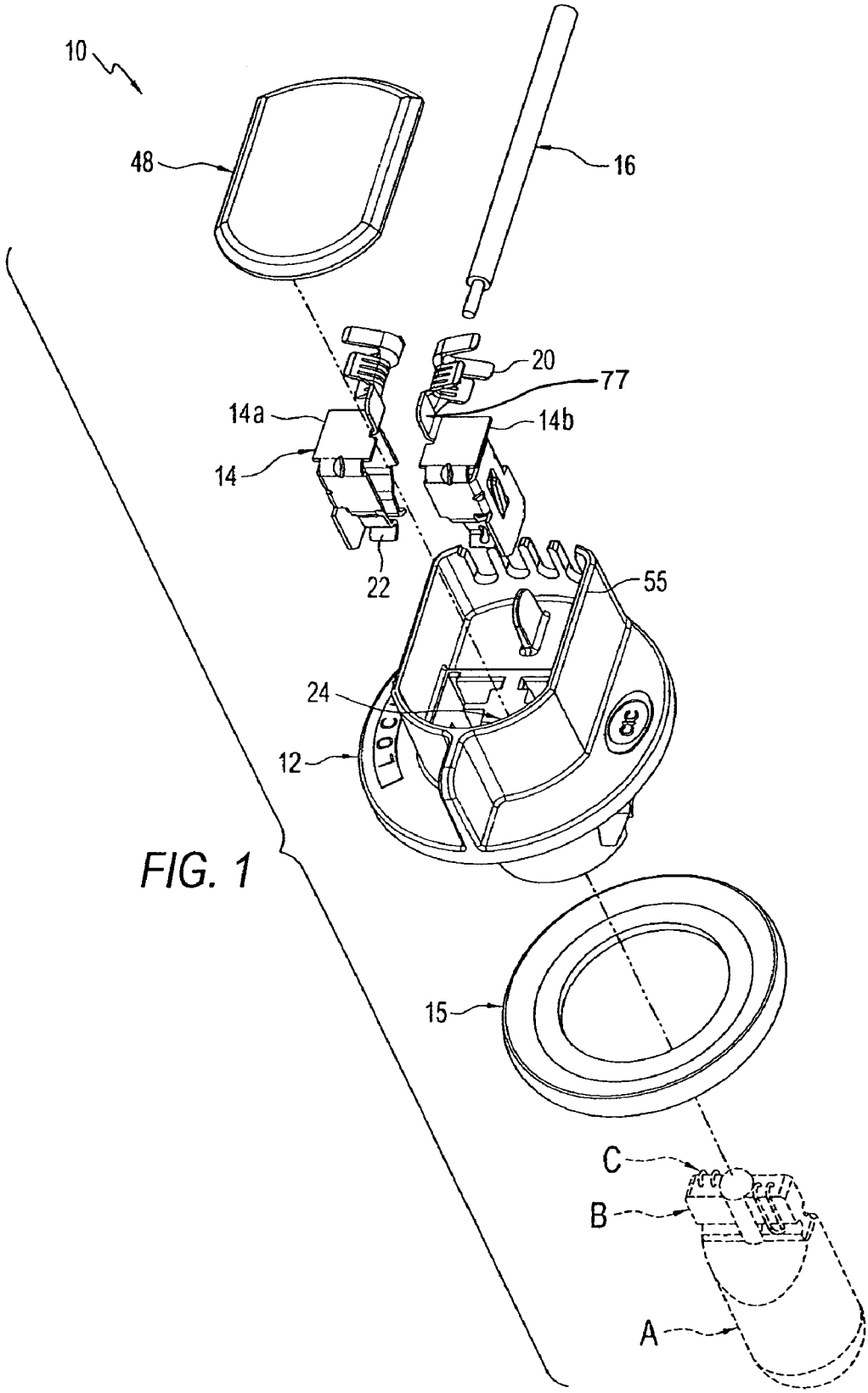
FIG. 1 is an exploded view of a W-2 lamp socket and lamp of the present invention.

In FIG. 1, a lamp socket 10 suitable in use with a single filament lamp A includes a socket body 12, terminals 14, and wire leads 16. Generally, assembly of the lamp socket 10 is accomplished by inserting leads 16 into respective crimp cradles 20 of the terminals 14 and crimping the cradle around the lead. One lead 16 is ground and the other lead provides power. The terminals 14 are then inserted into the socket body 12 from a back portion 24 of the socket body. After placing a gasket 15 around the socket body 12, the lamp A is aligned and inserted into a lamp base receiving channel 28. The terminals 14 provide mechanical and electrical connection between the lamp A and socket 10.

Figure 2:
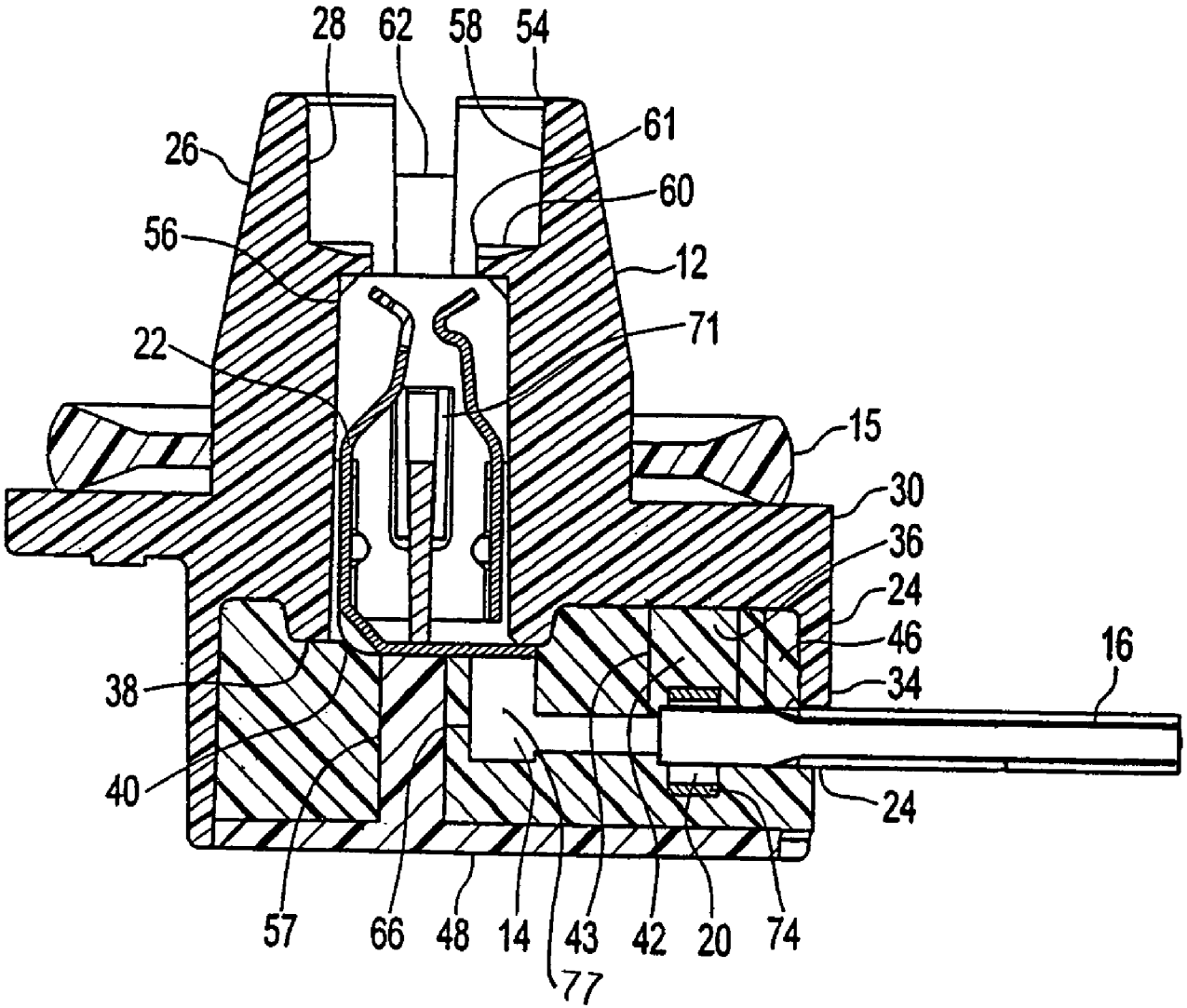
FIG. 2 is a vertical cross-section of the lamp socket of FIG. 1.
Figure 3:
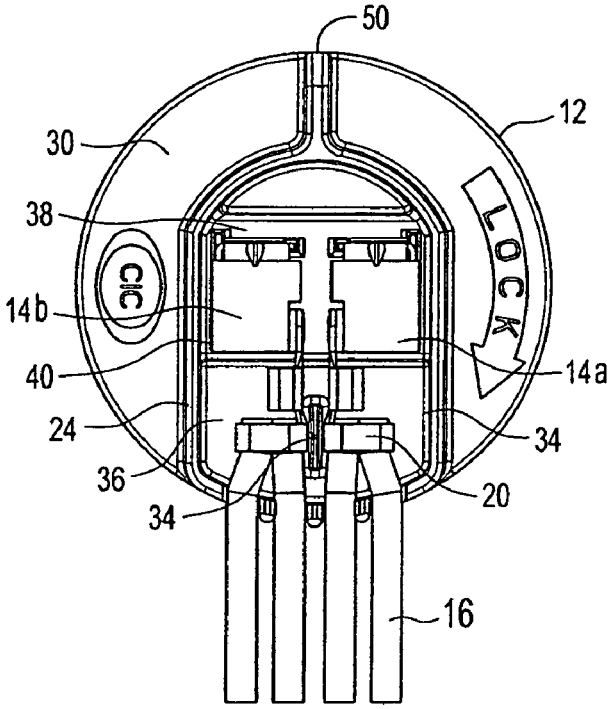
FIG. 3 is a bottom plan view of the unpotted socket of FIG. 1.

Referring now to FIGS. 2 and 3, the socket body 12 includes a back portion 24 and a lamp receiving portion 26. The socket body 12 is generally cylindrical with the back portion 24 being generally concentrically and axially disposed with the lamp receiving portion 26. A partition 30 divides the back portion 24 and the lamp receiving portion 26. The back portion 24 has at least one side wall 34 integrally formed in the socket body and defining a cup-shaped chamber for receiving the terminals 14 (best seen in FIG. 3).

The back side of partition 30 includes a shelf 38 and an adjacent recess 36. The recess 36 extends inwardly relative to the shelf 38. The shelf has a plurality of apertures 40 for receiving terminals 14. When the terminal 14 is installed in the shelf aperture 40 an end of the terminal 14 extends over the recess 36. The clearance space 42 is provided between the crimp cradle 20 and the lead 16 relative to the partition 30 at the recess 36. A wall 43 extends from the partition 30 between each of the left and right terminal connections to prevent a short circuit between terminals 14*a* and 14*b*. Further, at least one, preferably plural, openings 44 are defined in the side wall 34 for allowing the leads 16 to be fed outside of the socket body 12.

Terminals 14 are inserted into the back portion 24 of the socket body 12. The terminals include an alignment plate 68 having a cantilevered locking tab 71. The alignment plate 68 is inserted in a groove in the socket body partition 30 and functions to correctly align the terminal, set the terminal 14 at a proper vertical depth in the socket body, and prevent the terminal from rocking, twisting or otherwise becoming misaligned, which can lead to crushed terminals and socket failure. Further, the alignment plate 68 functions to protect the terminal blades 22 from damage in the assembly process. Cantilevered locking tab 71 locks the terminal 14 in the socket body 12.

Figure 4:
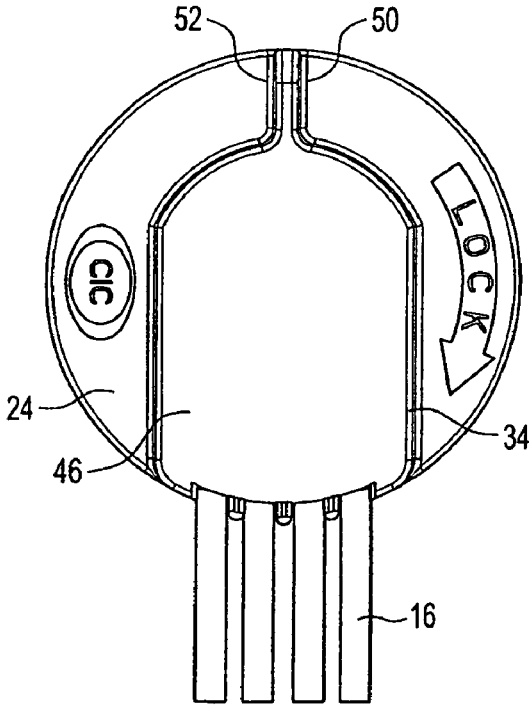
FIG. 4 is a bottom plan view of a potted socket of FIG. 1.

Referring now to FIG. 4, a potting resin or other material 46 is injected into the back side chamber defined by the partition 30 and the side wall 34, and seals the connection between the terminal 14 and the lead 16. When the resin 46 is introduced, the resin flows underneath the terminal 14 into the clearance space 42 between the terminal and the recess portion 36. The resin 46 locks the lead 16 in place in the terminal 14 by encapsulating the connection. The resin 46 also cements the terminal 14 in position.

An optional cap 48 may be provided over the back portion of the socket body 12. Cap 48 is preferably dimensioned to fit inside side wall 34. Tabs (not shown) may be provided to lock the cap 48 to the side wall 34. Alternatively, the cap 48 may include a shoulder extending over the top of the side wall 34 and arms extending down the wall. The arms include projections or other means to engage a groove, opening, recess or clip on the side wall 34. Interior legs 57 extend inwardly from the cap 48. If the socket body 12 is potted, the legs 57 are at least partly embedded in the resin 46 and function to hold the cap to the body. The cap 48 may be of the same or different material as the socket body 12 and may be color coded for a desired application, function or customer. Additionally, the cap 48 may be provided with a flat, smooth back surface so that it may be easily grasped by suction cup type automated assembly equipment.

Further, cap 48 may be provided in lieu of potting the socket. For fixtures that are used in interior locations, or that are otherwise not subject to moisture or other adverse environments, potting is not necessary. In the absence of potting, inwardly projecting legs 57 extend into engagement with the back of the terminals to provide terminal position assurance. For such interior fixtures, cap 48 can be an economical alternative to potting.

The exterior of side wall 34 may optionally be provided with an indent 55, such as a groove or other means for receiving a ball-spring connector of an automated assembly machine.

A tab 50 is preferably located on the back portion 24 of the socket body to provide a directional indicator for ease of insertion of the socket body 12 into an electrical fixture.

Referring back to FIG. 2, the lamp receiving portion 26 includes the lamp base receiving channel 28 that has a central circular opening 54 and a secondary generally rectangular slot 56 that corresponds to the generally rectangular cross-section profile of the lamp base B. The channel 29 is further defined by at least one lamp base channel side 58 in spaced relationship, and at least one lamp base end 60. At least one lamp side aperture 61 is defined by the lamp base end 60 for allowing the blades 22 of the terminal 14 to contact the lamp base B. A pair of vertical slots 62 may be disposed on the channel side 58 to guide the lamp A into the channel 28. Blades 22 provide compressive contact with the filament leads C on the lamp A.

Figure 5:
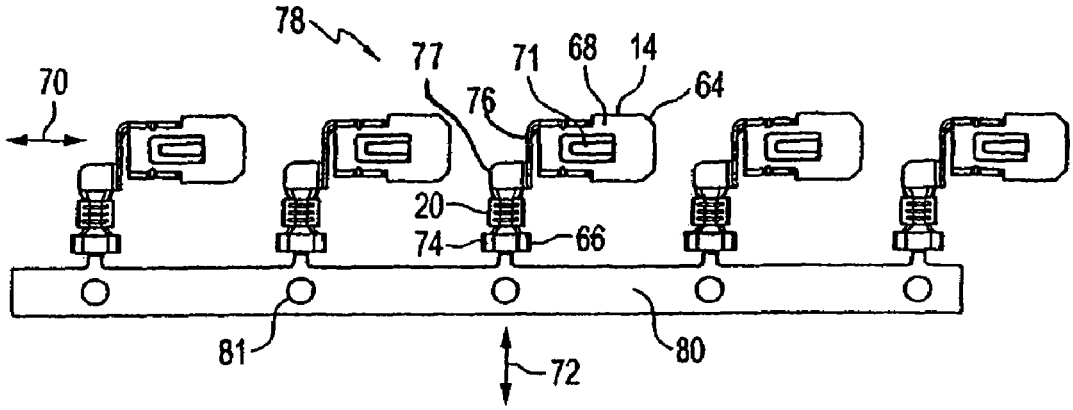
FIG. 5 is a top plan view of a preferred embodiment of a terminal strip of the present invention.
Figure 6:
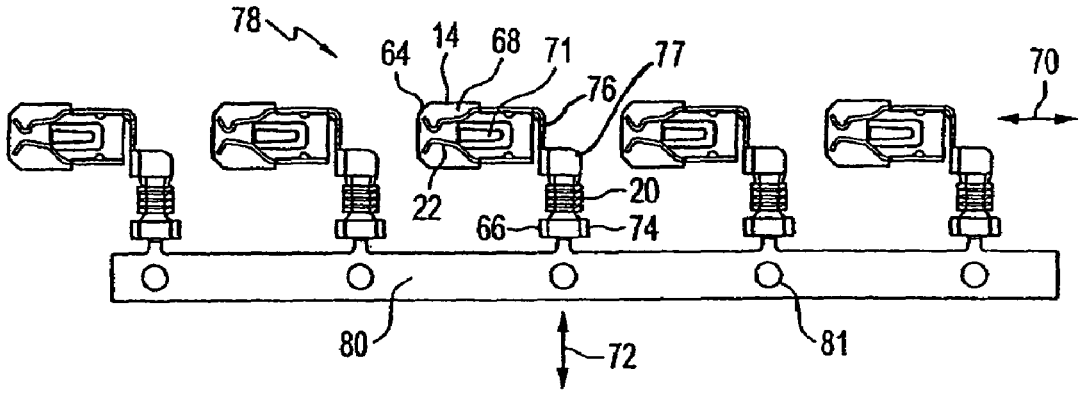
FIG. 6 is a bottom plan view of the terminal strip of FIG. 5.
Figure 7:
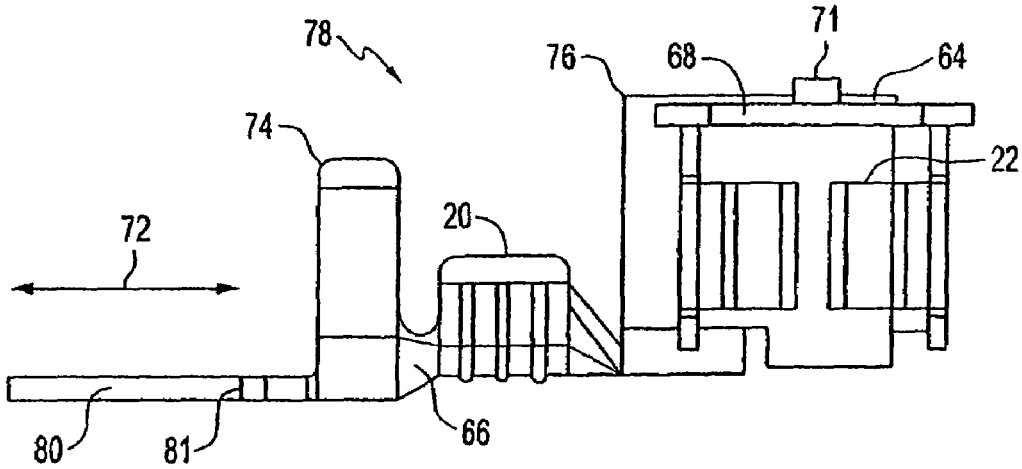
FIG. 7 is an end view of the terminal strip of FIG. 5.
Figure 8:
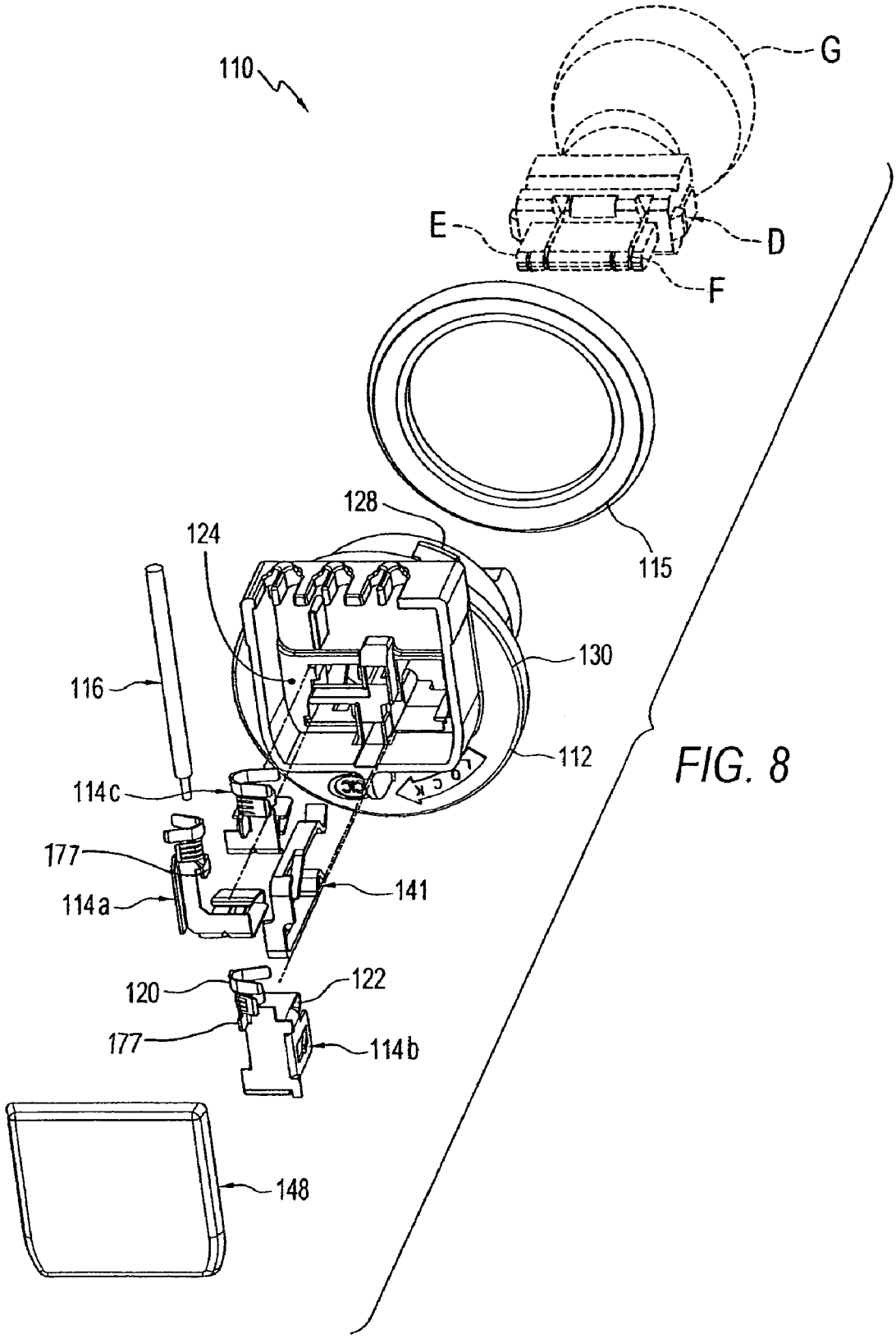
FIG. 8 is an exploded perspective of a W-3 lamp socket and lamp of the present invention.

Referring now to FIGS. 5–7, the terminal 14 has a lamp receiving end 64 and a lead receiving end 66, the lamp receiving end has an alignment plate 68 and opposed blades 22 which define a blade axis 70. The cantilevered locking tab 71 is disposed on the alignment plate 68 for locking the terminal 14 into the lamp base receiving channel 28 of the socket body 12. On the lead receiving end 66, crimp cradle 20 defines a cradle axis 72. Fingers 74 are crimped to the lead 16 to provide electrical and mechanical connection. In between the ends, the terminal 14 preferably includes a cover plate 76 that covers the partition aperture 40 to prevent potting resin 46 from flowing through to the lamp base receiving channel 28 of the socket body 12. The terminal further includes a riser 77 between lead end 66 and cover plate 76.

Multiple terminals 14 are stamped and fabricated from sheet metal, typically brass. The terminals are initially connected to one another by feed strip 80. The feed strip 80 includes pin feed holes 81 for feeding the terminals though automated wire striping and crimping equipment. The cradle axis 72 is in substantially the same plane as and extends outwardly relative to the strip 80. Further, the blade axis 70 is preferably at about a right angle from the cradle axis 72. The terminal 14 is thus a one-piece right angle terminal. Alternatively, the cradle axis 72 can be at an obtuse angle relative to the blade axis 70 so that the crimp cradle 20 extends outwardly from the partition 30 when installed. In the present embodiment, the cradle axis 72 and the blade axis 70 lie in the same horizontal plane or in substantially parallel horizontal planes with the strip 80.

Referring again to FIG. 2, when engaged in the socket body 12, the lead receiving end 66 of the terminal 14 is located in the back portion 24 of the socket body 12 and extends from the shelf 38 over the recess portion 36. At least one lead 16 is connected to the lead receiving end 64 of the terminal at the crimp cradle 20 at a location spaced outwardly from the recess portion 36. When mounted in the socket body 12, the crimp cradle 20 has a horizontal orientation with respect to the socket body. That is, the cradle fingers 74 extend horizontally from the crimp cradle 20 with respect to the partition 30 and are crimped by mechanical force to grip the lead 16.

FIGS. 8–11 illustrate a second embodiment of a lamp socket 110 of the invention suitable in use with a double filament lamp D. Like components of lamp sockets 10 and 110 have been designated with the same reference numbers, provided that socket 110 has numbers in the 100 series. The lamp socket 110 includes a socket body 112, terminals 114, and wire leads 116. Briefly, assembly of the lamp socket 110 is accomplished in much the same way as the assembly of the lamp socket 10. First, the lead 116 is inserted into a crimp cradle 120 of the terminal 114 and crimped. Second, a blade 122 of each terminal 114 is inserted into a back portion 124 of the socket body 112. A spring clip 141 is inserted into the socket body 112. After placing a gasket 115 on the socket body 112, the socket is then ready to receive a lamp D in channel 128.

The socket body 112 has a lamp receiving portion 126 and a back portion 124. The socket body 112 holds three terminals, 114*a*, 114*b* and 114*c*. The socket body 112 is generally cylindrical and the back portion 124 and the lamp receiving portion 126 are separated by a partition 130.

Conventional lamp D has a bulb G having major and minor filaments (not shown), and wedge base E. Filament leads F protrude from the bottom of the wedge base E and are bent around the exterior sides of the base, two on one side and two on the other. Conventional W-3 lamps typically have four leads E, the outer two for the major filament and the inner two for the minor filament. For each filament, one lead F that extends to one side of the wedge base E, and the other lead is on the other side of the base. As a result, the leads F on the one side of the base E are staggered or shifted relative to the leads on the other side. This allows the lamp D to be inserted either way into the socket.

Figure 9:
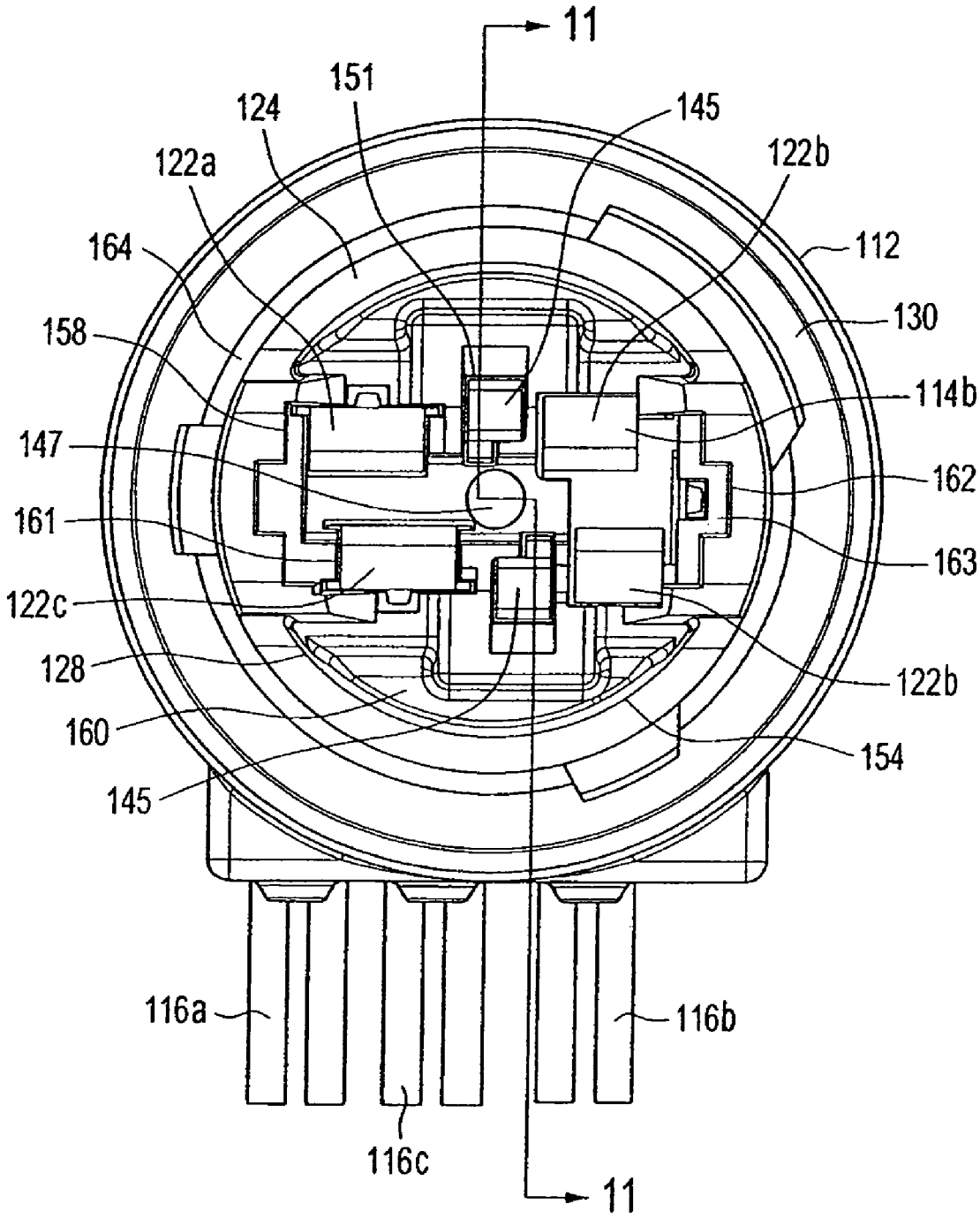
FIG. 9 is a top plan view of the socket of FIG. 8.

Referring to FIG. 9, the lamp receiving portion 124 of the socket body 112 is configured to accept a two filament, W-3 lamp D. Preferably, four terminal blades 122 are positioned in channel 128 to make electrical contact with each of the filament leads F respectively. The two blades 122*b* on the right side are wired to ground. The two blades 122*a* and 122*c* on the left side are major and minor terminals, 114*a* and 114*c* respectively. As a result of the geometry of the lamp D, described above, the terminal blades 122 are staggered relative to one another.

The terminals 114 are typically fabricated from a metal having good conductive properties, such as brass. However, brass is relatively soft and as such is not preferred for mechanically securing the lamp in the socket body 112. Spring clip 141 is therefore provided to assist in securely holding the lamp in the socket body. The clip is positioned in the center of the channel 128 between the terminal blades 122 to grasp the lamp base E. The spring clip 141 has two prongs 145. The prongs 145 are offset from each other, and accordingly are spaced mid-way between terminals 114 on both sides of channel 128. Likewise, the prongs 145 are spaced midway between filament leads F when the lamp D is installed. Because of the mid-point spacing of prongs 145 relative to both the terminals 114 and lamp leads F, the prospects for a short circuit to the spring clip 141 are minimized.

The clip 141 is preferably fabricated from a material having superior spring properties such a stainless steel. It provides a constant inward biasing force when a lamp base is inserted into the clip.

Also shown in FIG. 9 is the lamp base receiving channel 128 which defines a circular opening 154. The lamp base receiving channel 128 also includes a lamp base end 160 with a raised region defining lamp side terminal apertures 161, and further, a second raised portion defining lamp side clip apertures 151. On at least one lamp base channel side 158, at least one pair of vertical slots 162 is disposed for easily inserting the lamp base E. Also disposed in the lamp receiving channel 128 at the bottom of the slots 162 are angled stops 163 which limit the downward movement of the lamp D. When the wedge base E is inserted into the lamp base receiving channel 128, the vertical slots 162 guide the wedge base downward, between the prongs 145 and the lamp receiving ends 164, until the lamp D hits the stops 163. The spring clip 141 positively retains the lamp D until removed by applying a firm pulling force.

The lamp receiving portion 126 and back portion 124 of the socket bodies 12 are divided by partition 130. The back portion 124 of the body 112 has at least one side wall 134 defining a chamber 128. The back side of the partition 130 includes a shelf 138 and an adjacent recess 136. The recess 136 is spaced inwardly into the partition relative to the shelf. The shelf 138 is positioned generally axially with the socket body 112 and has, in this embodiment, three partition apertures 140 which are configured to accept terminals 114*a*, 114*b*, and 114*c*. The terminals 114 are inserted into partition apertures 140. The back or lead receiving end of each terminal 114 extends over the recess 136 in the partition 130 such that there is a clearance 142 between the bottom of recess 136 and the terminal 114. The clearance 142 enables resin 146 to be introduced under the terminals 114 to fully encapsulate the connection between the wire leads 116 and terminal 114.

Figure 10:
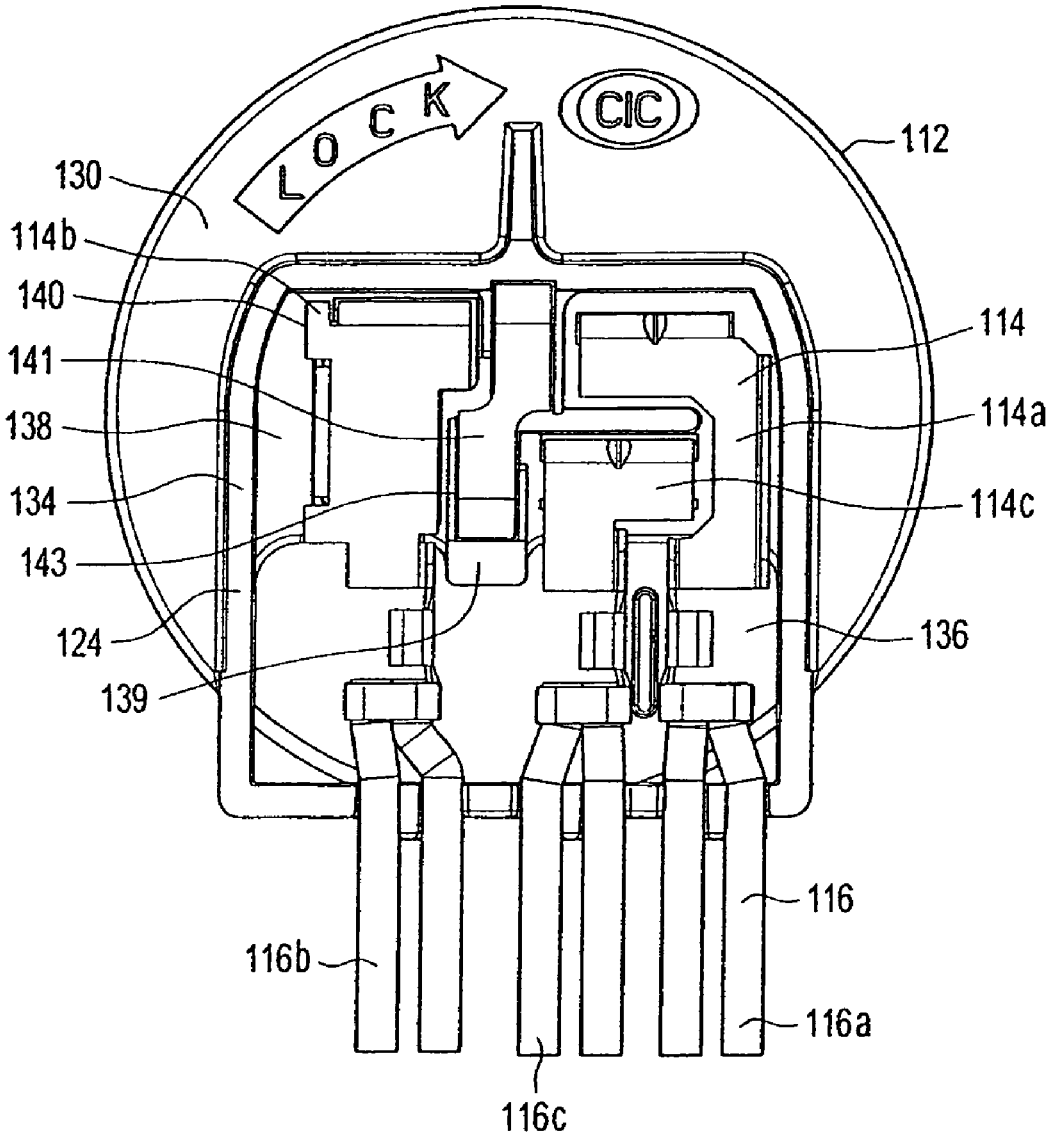
FIG. 10 is a bottom plan view of the unpotted socket of FIG. 8.

Referring to FIG. 10, the back portion 124 of the socket body 112 further comprises a projection 139 extending outwardly from the partition 130 relative to the shelf 138 and inwardly spaced from the side wall 134. Projection 139 has a generally offset rectangular shape, having a pair of apertures 143 on each side for receiving the spring clip 141. Projection 139 helps isolate the spring clip 141 from the terminals 114 minimizing a short circuit.

Figure 11:
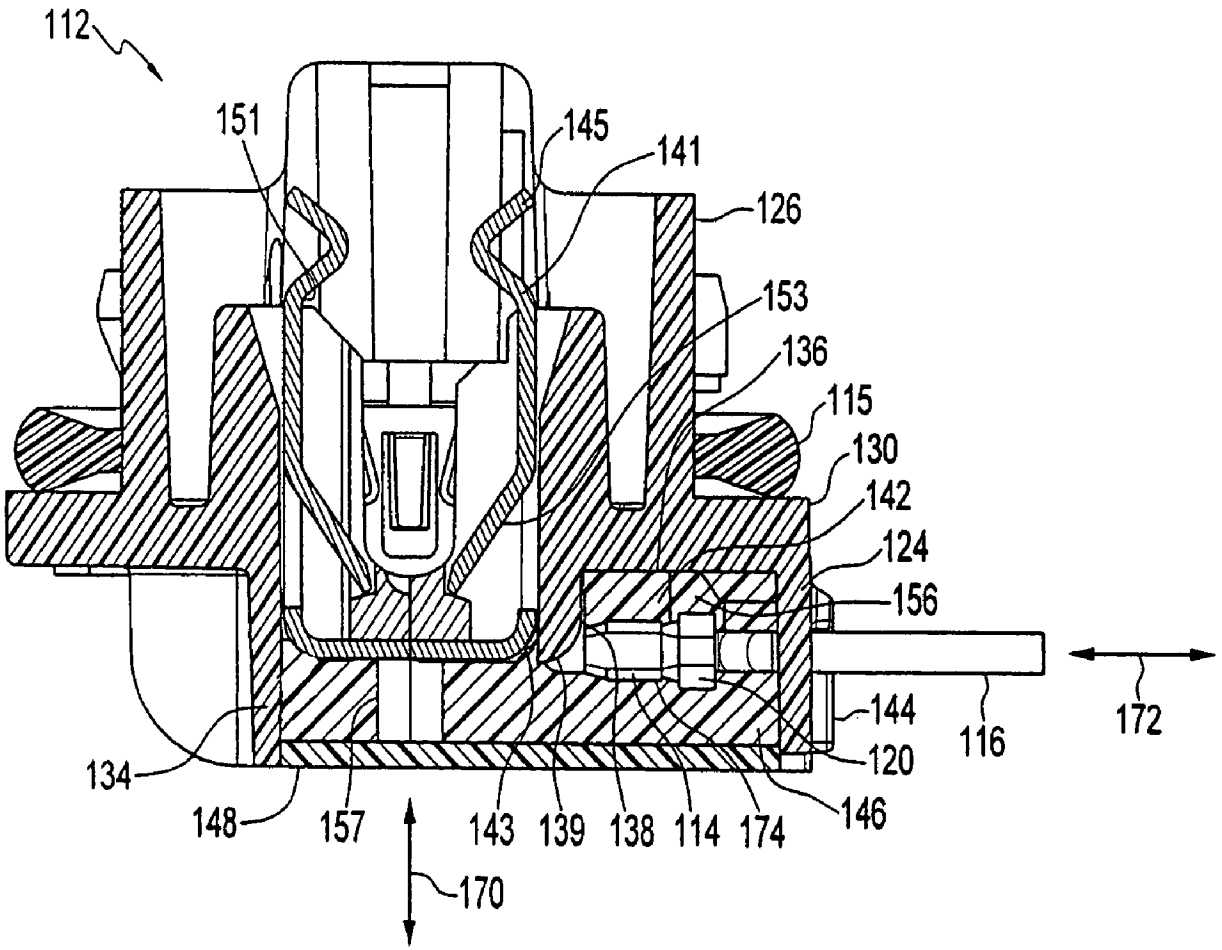
FIG. 11 is a vertical cross section of the socket of FIGS. 8–10 taken along line 11—11 of FIG. 9.

FIG. 11 shows the spring clip 141 in the socket body 112. Insertion of the spring clip 141 is accomplished by inserting the prongs 145 in apertures 143 in the back portion 124 of the socket body. The spring clip 141 is permanently locked in the lamp receiving portion 126 by a pair of cantilevered locking tabs 153. The cantilevered tabs 153 are located on the prongs 145 preferably on the inside of the rectangular "U" shape. Once the cantilevered tabs 153 pass through and clear the lead side clip aperture 143, they permanently engage partition 130 preventing the clip from being unintentionally dislodged.

Similar to the first embodiment, the terminals 114 have a cradle axis 172 and a blade axis 170 that are substantially perpendicular and lie in the same horizontal plane or substantially parallel planes. When mounted in the socket body 112, cradle fingers 174 extend horizontally from the crimp cradle 120 with respect to the bottom wall 132 and are crimped by mechanical force to grip the at least one lead 116.

Further, like socket body 12, the back side of partition 130 comprises a wall 156 between two of the terminals 114 located on the same side of the back portion 126 to prevent a short circuit. Also, at least one opening 144, preferably several, are located on the side wall 134 for allowing the lead 116 to be fed outside the body socket 112. The present W-3 embodiment generally has three leads 116, namely ground 116*b*, major 116*a* and minor 116*c*.

After being fabricated and crimped to leads 116, terminals 114 are inserted into the apertures 140 in the back portion 124 of the socket body. The spring clip 141 is also inserted into aperture 143 in the projection 139. Once both the terminals 114 and the spring clip 141 have been inserted, resin 146 can be placed within the side walls 134 and underneath and over the connections between the terminals 114 and the leads 116. Similar to the socket body 12, an optional cap 148 with legs 157 may be secured within the side walls 134 by pressing legs 157 into the resin 146. Alternatively, cap 148 can be secured to the exterior of the side walls 134, as discussed relative to the first embodiment. Optionally, interior legs 157 of the cap 148 can press down onto the terminals 114 to assist in holding the terminals in place. The lamp 118 can be inserted into the socket body 112 by inserting the wedge base B into channel 128.

Accordingly, the lamp socket of the embodiments discussed above provides a socket body with a raised shelf and a recessed portion which allows the resin to seal around the connection. Another feature of the socket body is an optional cap for the back of the socket. A terminal is also provided which includes a crimp cradle and a blade having an orientation such that the terminal lies substantially in the same horizontal plane. The present invention also provides a spring clip that has offset prongs to grip a wedge base lamp midway between terminals and leads. The spring clip comprises locking tabs that permanently retain the clip within the socket body.

While particular embodiments of the lamp socket has been shown and described, it will be appreciated by those skilled in the art that changes and modifications may be made thereto without departing from the scope of the invention set forth in the following claims.

What is claimed is:

1. A lamp socket for a wedge base lamp comprising, a socket body having a lamp receiving portion, a back portion and a partition there between;

at least two right angle terminals in said socket body, each of said terminals having a lamp receiving end and a lead receiving end, said lead receiving end located in the back portion of said body;

at least one wire lead connected to each respective lead receiving end of each of said terminals;

a metal spring clip having two prongs extending into the lamp receiving portion of said body for gripping the respective sides of the lamp base, said prongs being laterally offset from one another; and potting material in the back portion of said socket body sealing the connection between said terminals and said leads.

2. A lamp socket as in claim 1 wherein said spring clip is stainless steel.

3. A lamp socket comprising, a socket body having a lamp receiving portion, a back portion and a partition there between, said lamp receiving portion having a lamp base receiving channel, said channel having spaced apart sides;

at least two terminals in said socket body, each said terminal having a lamp receiving end and a lead receiving end, said lead receiving ends located in the back portion of said body, said lamp receiving ends of said at least two terminals comprising a total of at least four terminal blades, said terminal blades being in said channel with two blades on each side of said channel, the blades on each side of said channel being laterally offset relative to the blades on the other side of said channel;

at least one wire lead connected to each of the lead receiving ends of said terminals;

a spring clip inserted in the back portion of said body and having prongs extending into said lamp receiving portion of said body with a prong on each side of said channel, each respective prong being spaced midway between said terminal blades, said prongs being laterally offset relative to each other; and potting material in the back portion of said socket body.

4. A lamp socket as in claim 3, wherein said partition has a recess adjacent said lead receiving end of at least one of said terminals, said lead receiving end being spaced apart from said partition and said potting material filling said recess and said space between said lead receiving end and said partition.

5. A lamp socket comprising:

a socket body having a lamp receiving portion, a back portion and a partition there between having at least one aperture;

at least one terminal installed in said at least one aperture, said terminal having a lamp receiving end having a blade axis, a lead receiving end having a cradle axis, and a riser there between, said cradle axis being at an angle relative to the blade axis, said riser axially spacing said lead receiving end outwardly apart from said partition;

at least one wire lead connected to said lead receiving end of said terminal;

potting material in the back portion of said socket body between said partition and said lead receiving end and encapsulating the connection of said wire lead to said lead receiving end of said terminal; and a cover plate for covering said aperture in said partition, wherein said cover plate is integrally formed with said terminal and said riser is between said cover plate and said lead receiving end.

6. The lamp socket of claim 5 wherein said partition comprises a recess juxtaposed to said terminal lead receiving end.

7. The lamp socket of claim 5 further including a metal spring clip having two prongs extending into the lamp receiving portion of said body for gripping respective sides of the lamp base, said prongs being laterally offset from one another.

8. The lamp socket of claim 7 wherein said spring clip is stainless steel.

9. A lamp socket comprising, a socket body having a lamp receiving portion, a back portion and a partition there between, said lamp receiving portion having a lamp base receiving channel, said channel having spaced apart sides;

at least two terminals in said socket body, each said terminal having a lamp receiving end and a lead receiving end, said lead receiving ends located in the back portion of said body, said lamp receiving ends of said at least two terminals comprising a total of four terminal blades, said terminal blades being in said channel with two blades on each side of said channel, one blade on one side of said channel being laterally offset relative to another blade on the other side of said channel;

at least one wire lead connected to each of the lead receiving ends of said terminals;

a steel spring clip inserted in the back portion of said body and having prongs extending into said lamp receiving portion of said body with a prong on each side of said channel, each respective prong being between and spaced apart from said terminal blades, said prongs being laterally offset relative to each other, said spring clip having at least one locking tab engaging said socket body and locking said clip into said socket body; and potting material in the back portion of said socket body.

10. A lamp socket for receiving a wedge base lamp, comprising, a socket body having a lamp receiving portion, a back portion and a partition there between, said lamp receiving portion having a lamp base receiving channel;

a plurality of one-piece terminals in said socket body, at least two of said terminals having one or more lamp receiving blades located in the lamp receiving portion of said socket body and a lead receiving blades located in the back portion of said body, said lamp receiving end having a blade axis, said lead receiving end having a cradle axis, the cradle axis being at an angle relative to the blade axis, each of said at least two terminals further comprising a cover plate between the lamp blades and the lead receiving end and a riser adjacent the lead receiving end, the riser axially spacing the lead receiving end outwardly relative to the cover plate;

at least one wire lead connected to each of the lead receiving ends of said terminals;

a steel spring clip in the back portion of said body and having prongs extending into said lamp receiving portion of said body, one prong being on each side of said channel, the prongs being spaced apart from said terminal blades, the prongs being adapted to grip and securely hold the lamp base; and potting material in the back portion of said socket body encapsulating the connection of said wire leads to the lead receiving ends of said terminals.

* * * * *